United States Patent [19]

Taylor et al.

[11] Patent Number: 4,457,401

[45] Date of Patent: Jul. 3, 1984

[54] ABOVE-THE-FLOOR HYDRAULIC LIFT

[75] Inventors: James J. Taylor, Lewisville; John Dicinque, Burlington, both of N.C.

[73] Assignee: Gilbert & Barker Manufacturing Co., Inc., Greensboro, N.C.

[21] Appl. No.: 366,845

[22] Filed: Apr. 9, 1982

[51] Int. Cl.[3] ..... B66F 7/04

[52] U.S. Cl. ..... 187/8.49; 187/8.59

[58] Field of Search ..... 187/8.59, 8.5, 8.49, 187/8.47, 8.41, 8.64, 9 E; 254/93 L, 93 R, 2 C, 2 R

[56] References Cited

U.S. PATENT DOCUMENTS 2,702,606 2/1955 Young ..... 187/8.41

2,849,084 8/1958 Hott et al. ..... 187/8.5

FOREIGN PATENT DOCUMENTS 45488 4/1972 Australia ..... 187/8.41

289616 2/1963 Netherlands ..... 187/8.41

*Primary Examiner*—Joseph J. Rolla

*Assistant Examiner*—Thomas Fitzgerald

[57] ABSTRACT

An above-the-floor freestanding drive-through vehicular hydraulic lift in which a pair of laterally-spaced cylindrical columns enclose hydraulic elevating mechanisms and each column supports a vertically displaceable lifting assembly for engaging a vehicle in synchronization with an adjacent vertically displaceable lifting assembly on an adjacent column for supporting and elevating a vehicle to selected working locations. A lifting a lowering assembly is provided with an automatic locking and safety mechanism for sensing obstructions to which the supporting and elevating mechanism may be subjected in elevated and lower a vehicle supported on the hydraulic lift.

6 Claims, 9 Drawing Figures

ABOVE-THE-FLOOR HYDRAULIC LIFT

BACKGROUND AND OBJECTIVES OF THE PRESENT INVENTION

Vehicular hydraulic lifts whether of single or two port constructions generally are installed below ground level and move vertically through supporting cylinders by means of an hydraulic system with the supporting bolsters pivotably supporting swing arms for engaging the undercarriage of a vehicle to be elevated. The vertically movable pistons are accurately machined and the cylinders are subjected to damage and corrosion by reason of their location in the path of mechanics working beneath the vehicle and drainage problems in the area of lift installation necessitating considerable maintenance.

Various single post and double post vehicular lifts are widely used including the type shown in U.S. Pat. No. 3,393,772 which relates to a single post lift elevatable from below ground level. A two-post hydraulic lift vertically movable from below the ground level is disclosed in U.S. Pat. No. 3,331,470. Single post and double post above-the-ground lifts have also been used but generally they are constructed with structural support columns having open rectangular cross-sectional configurations, and are generally rather massive units occupying substantial floor space. The synchronization systems employed are relatively complex and necessitate substantial maintenance as do the hydraulic cylinders since they are relatively unguarded or protected.

The present above-the-floor vehicle hydraulic lift is "free-standing" and has the advantages of utilizing standard cylindrical columns of large diameter, unfinished, low carbon steel pipe which eliminates costly machining and hardening operations common with many lift designs and the problems incident to welding of essential components to the fabricated structure. Of considerable advantage in the present construction using the hollow cylindrical cross-sectional area of the double post above-the-floor lift columns, the enclosed construction provides a suitable integral protected enclosure for the hydraulic drive and lifting cylinders which will be protected from damage whether from improperly loaded vehicles or from accidents caused by mechanics working on the vehicles. By isolating the hydraulic cylinders within the columns of the lift, in addition to removing them from danger in the working area and from under an elevated vehicle, the critically important hydraulic system remains protected at all times thereby extending the useful life of the lift and keeping it relatively maintenance free.

With the large scale conversion to smaller cars and front wheel drives, the above-the-floor lift of the present invention is well suited to accommodate the off-center eccentric loading of the smaller vehicles while at the same time being able to adapt readily to the front to rear eccentric loading encountered by front wheel drive vehicles, since the column's cylindrical cross-section has equal strength in all directions.

The utilization of large diameter columns permits the use of larger stabilizing contoured rollers for supporting the carriage or bolster lifting arm assembly thereby decreasing appreciably the stresses to which the column and the rollers may be subjected resulting in decreased wear and longer operating life for the lift.

The hydraulic drive system utilizes two hydraulic lifting cylinders driven by a standard hydraulic power unit with interconnecting fluid lines with each of the cylinders being positioned in one of the columns and the hydraulic cylinders are positively synchronized by reason of their inverted relationship each to the other permitting hydraulic fluid in the rod end of the drive cylinder to be displaced into the rod end of the slave or nondrive cylinder and vice versa, making them move in synchronization and in equal increments. The synchronization of the hydraulic lifting cylinders eliminates the necessity of tying the displacement of the two cylinders together with chain or cable mechanisms. The simplicity of the positive hydraulic synchronization reduces wear, breakage and stretch appreciably affording a positively synchronized drive that is relatively insensitive to malfunction since no moving parts associated with the drive train of the lift are housed in the base which connects and supports the two lift columns.

An automatic locking mechanism is provided which prevents the downward movement of a supported vehicle, in a fail safe condition, in the event that a chain or chain support member fails. Tripping or tilting of a vehicle on its side which may occur on many lifts is prevented since any obstruction to downward movement is sensed causing the lift to be disabled until a correction is made. A lock pawl mechanism that is spring loaded will enable the lift arms and bolster to be lowered in increments under manual control with a chain-sensing mechanism that will override the manual control in the event a slack chain is detected in either column of the lift.

Therefore, an objective of the present invention is to provide an above-the-floor free-standing double column vehicular hydraulic lift in which the hydraulic system is enclosed within the columns of the lift to protect the hydraulic system and provide a compact drive-through vehicle lift.

Another objective of the present invention is to provide an above-the-floor hydraulic lift in which large diameter pipe may be utilized without costly machining and welding or hardening to provide a highly stable vehicle lift in which the lifting mechanism is hydraulically synchronized without moving mechanical parts and minimal rotation of the bolsters is encountered.

Yet a further objective of the present invention is to provide and above-the-floor hydraulic lift with an automatic locking system for maintaining the vehicle at a selected elevation and to lower the lift in increments that will be manually controlled but subjected to a sensing mechanism for detecting improper conditions precluding further manual operation until rectification of the problem detected.

Other objectives and many of the attendant advantages of this invention will become more readily apparent to those skilled in the hydraulic lift art and from the following detailed description of a preferred embodiment taking in conjunction with the accompanying claims which are not intended in any limitative sense and equivalents are intended.

SUMMARY OF THE INVENTION

An above-the-floor hydraulic lift in which a pair of vertical stanchions are spaced laterally from each other to accommodate a vehicle therebetween. A vertically displaceable bolster is mounted on each stanchion for controlled vertical displacement by means of a synchronized hydraulic system positioned in each of the vertical stanchions which stanchions are constructed of relatively large diameter low carbon steel pipe with one of the hydraulic members serving as the drive member in one stanchion and a second hydraulic system in the other adjacent stanchion or pipe serving as the slave or driven unit. The interconnection of the hydraulic systems is such as to synchronize the displacement of the bolsters mounted on the vertical stanchions to which bolsters the vehicle supporting pivotable arms are connected for engaging a vehicle to be elevated. Releasable automatic locking means is provided for maintaining the bolsters in a predetermined elevation even if any malfunction occurs. A manually operated release mechanism controls the lowering of the elevated bolsters subject to the hydraulic system and a sensing mechanism which will override the manual operation in the event of any malfunction that is detected on either column through the introduction of a slack cable which will allow the automatic locking pawl to return to an engaged locked position.

BRIEF DESCRIPTION OF DRAWINGS OF THE INVENTION

DETAILED DESCRIPTION OF PREFERRED EMBODIMENT OF THE INVENTION

The Above-The-Floor Vehicular Lift

Figure 1:
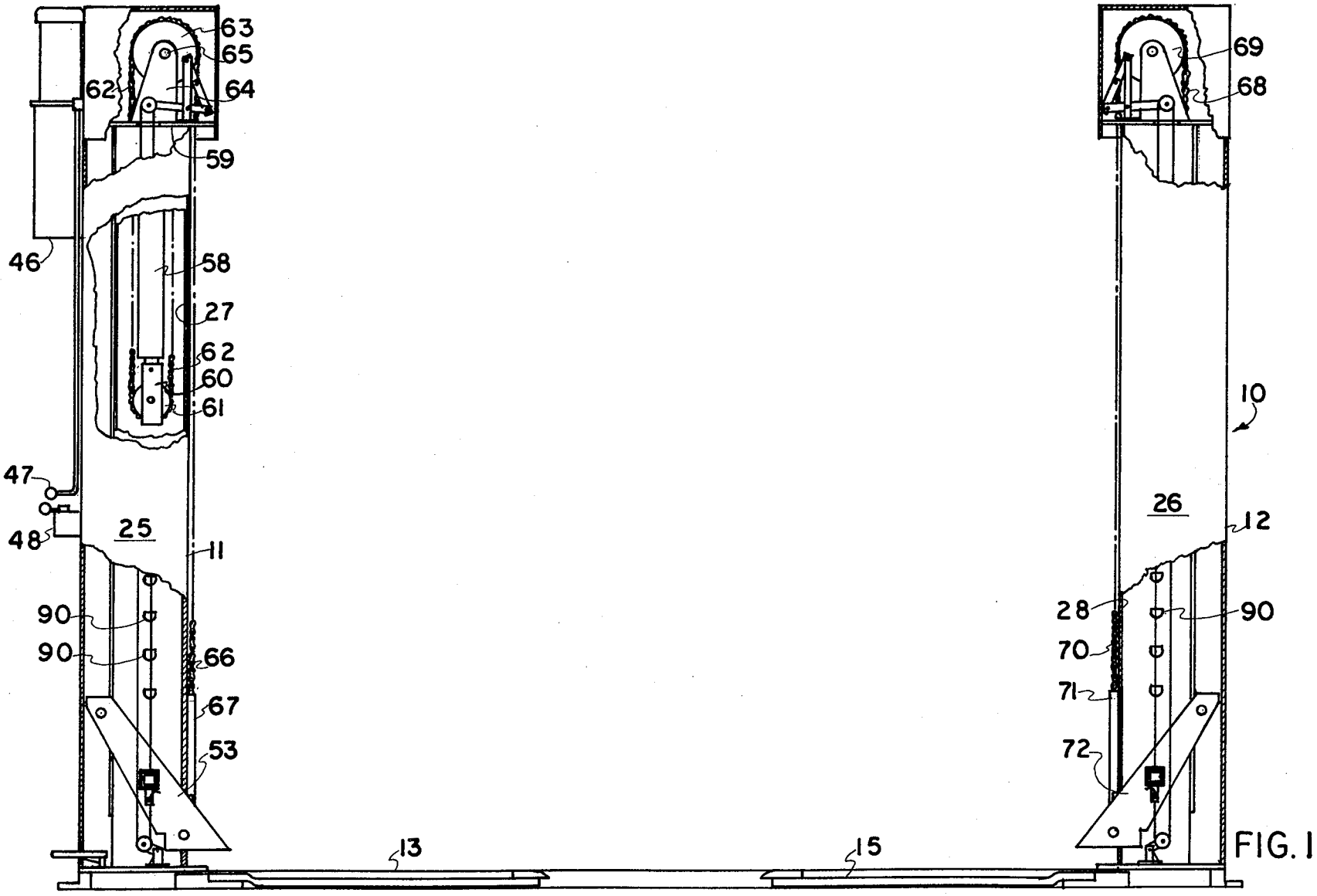
FIG. 1 is a front elevational view of the above-the-floor drive-through hydraulic lift in the lift lowered position with longitudinal portions of the housing and stanchions removed to illustrate selected interior sections.
Figure 2:
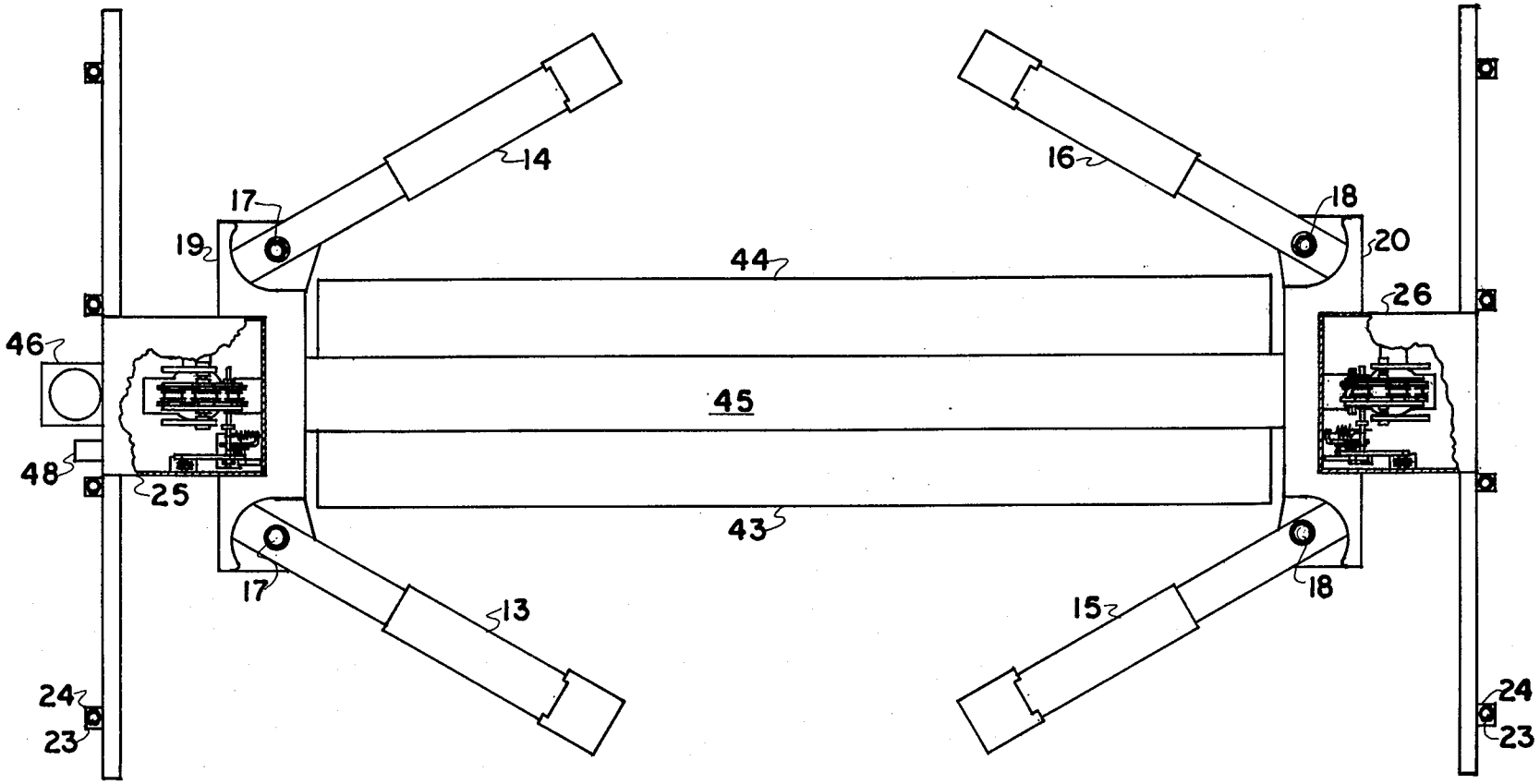
FIG. 2 is a top plan view of FIG. 1 with portions of the housing removed to show sections of the internal mechanism above each stachion.

Referring to the drawings and particularly to FIGS. 1, 2, 3 and 7, there is shown an above-the-floor vehicle lift 10 which includes a pair of vertical stanchions 11 and 12 which are laterally spaced from each other to permit a vehicle to pass between the stanchions and to be elevated to an appropriate level by means of the vehicle supporting and telescoping swing arms 13 and 14 mounted to the stanchion 11, and 15 and 16 mounted to the stanchion 12 through the pivot mounting locking bolts 17 for swing arms 13 and 14 to the vertically displaceable bolster 19 mounted on the stanchion 11. The pivot mounting locking bolts 18 support the swing arms 15 and 16 on the bolster 20 that is vertically displaceable on the stanchion 12.

Stanchion stabilizing rails 21 and 22 are secured to the base of the stanchions 11 and 12, respectively, and are securely anchored to a concrete floor or base by means of anchor bolts 23 that extend through the rails lugs 24 which are welded to the stabilizing rails 21 and 22 at spaced longitudinal intervals to maintain the stanchions 11 and 12 in vertical alignment.

The exterior casing or housing 25 and 26 encloses the interior of each stanchion and may be made of suitable sheet metal and provide a decorative exterior facing with the casing being secured for easy removal for accessibility to the stanchion interior. A low carbon steel pipe 27 is vertically supported in the stanchion 11 with the pipe having unmachined interior and exterior surfaces and a circular cross-section throughout its longitudinal length. A similar pipe 28 is installed vertically in stanchion 12.

Figure 3:
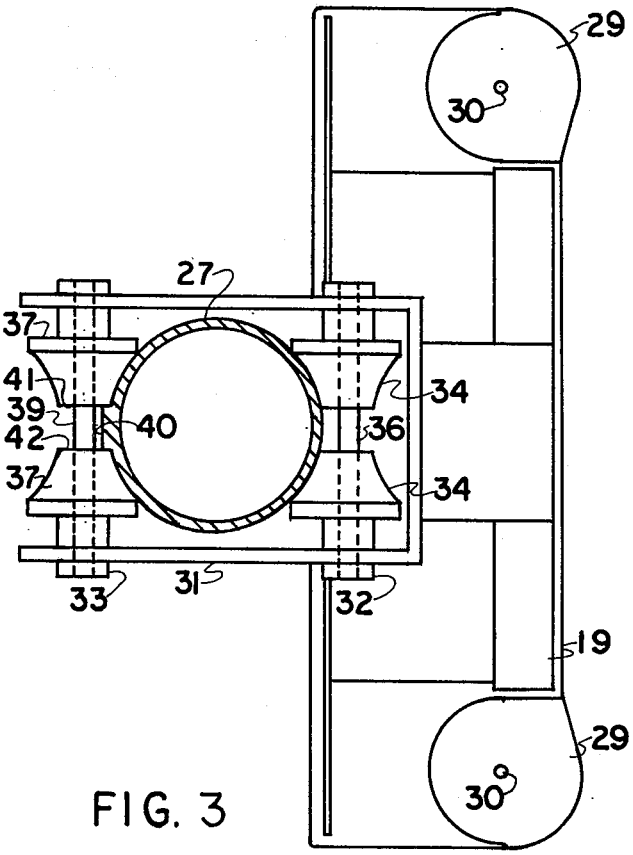
FIG. 3 is a partial plan view of one bolster mounted on a stanchion shown in cross-section omitting the lift arms.

FIG. 3 illustrates the pipe 27 of the stanchion 11, and it will be appreciated that a description of the elements in FIG. 3 for the pipe, bolster, and other components will be applicable also to the bolster 20 for the stanchion 12. The bolster 19 is provided with a pair of recessed pivot arm retaining grooves 29 at opposite ends of the plate of bolster 19 for cooperatively receiving the swing arms 13 and 14, at the free ends of which are vehicle-engaging lift pads of conventional construction, through the openings 30 provided therein for receiving the arm locking bolts 17 that pivotally retain the telescoping swing arms 13 and 14.

A shaft-retaining wall or shell 31 forms an upstanding guard that is secured to the plate 19 for supporting the stub shafts 32 and 33. The concically-shaped roller sections 34 are mounted on the shaft section 36 to engage with a portion of the periphery of the exterior of the pipe 27. The opposite side of the pipe 27 is also engaged by conically-shaped spaced roller sections 37 that are mounted on the shaft section 39, which is also retained in the wall 31, with the conical surface of roller section 37 engaging a portion of the periphery of the pipe 27 opposite from the roller section 34. A longitudinally-extending flat guide bar 40 is secured, as by welding, to the longitudinal exterior of pipe 27 guidably to engage surfaces 41 and 42 of roller sections 37 to prevent rotation of the plate 19 about the pipe 27 during vertical displacement of the bolster plate 19 whether or not a vehicle is being supported on the swing arms 13 and 14. Since the same arrangement for preventing rotation of the bolster plate 20 is mounted on similar spaced roller sections, the bolster plates 19 and 20 will be prevented from rotating or pivoting from the position shown in FIGS. 2 and 3 during vertical displacement of bolsters 19 and 20.

Upwardly inclined steel plates 43 and 44 are provided between stanchions 11 and 12 which cooperate with the cover plate 45 supported therebetween and under which plate 45 hydraulic lines and cables will extend, preferably in a shallow trench or chamber, from one stanchion to the other without interference or exposure.

A power unit and motor assembly 46 of conventional construction is supported at the upper level of the housing 25 on stanchion 11 and is controlled by levers 47 and 48 mounted at a convenient height which controls the displacement of the bolsters 19 and 20 through activation of the hydraulic system.

Figure 7:
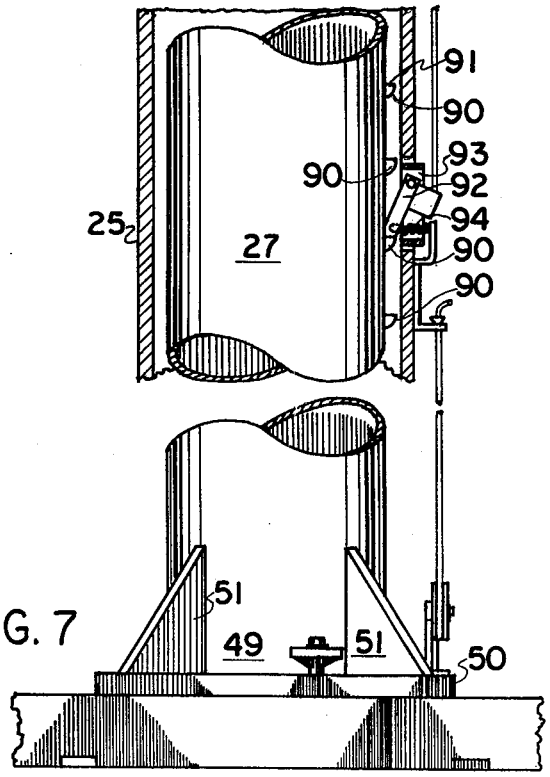
FIG. 7 is a partial longitudinal view with sections removed illustrating the stachion and lift locking mechanism.

FIG. 7 illustrates the base of one of the stanchions 11 with the lower end 49 of the pipe 27 being saddled on the base plate 50 and supported by the gusset plates 51 at circumferentially spaced locations about the perimeter of the lower end 49 of pipe 27 and retained in position by suitably welded joints.

Figure 8:
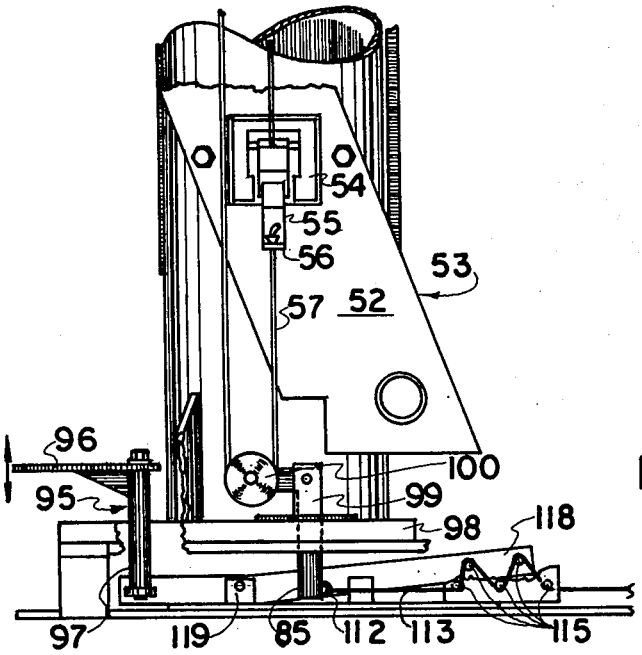
FIG. 8 is an enlarged partial front elevational view of the left stachion of FIG. 1 illustrating portions of the foot pedal for disengaging the locking mechanism of the automatic lock.

The exterior housing 52 about the wall or shell fabrication 31, shown in FIGS. 3 and 8, for the carriage assembly 53, incorporates an automatic lock latch assembly 54 on its side. A depending cable bracket member 55 is attached at its end 56 of cable 57, the function of which will be described hereafter.

The Hydraulic Drive System

Referring to FIGS. 1, 4, 5, 6 and 9, various aspects of the hydraulic drive system will be described in conjunction with the hydraulic cylinders which are positively synchronized since they are inverted relative to each other within the pipes 27 and 28, with only one shown in the pipe stanchion 27 as the drive unit. The hydraulic drive cylinder 58 is securely suspended within the pipe 27 from the upper closure plate member 59 through a universal clevis joint (not shown), and is provided with a depending block 60 extending from the piston rod for rotatably supporting the chain pulley 61 through chain 62 which extends upwardly for retention on the plate 59 at one chain end and over the chain pulley member 63 that is rotatably supported on the upstanding pulley brackets 64 that are secured to the upper plate 59 with the pulley 63 being rotatably mounted through the bearing and shaft 65. Pulley 63 retains the chain 62 from the hydraulic system 58 which will drive the pulley 63 to raise and lower the chain section 66 that is connected securely to the carriage-retaining lug member 67 thereby to raise and lower the carriage assembly and connected lift arms upon actuation of the hydraulic system and disengagement of the automatic locking mechanism.

In the pipe 28, the slave or driven hydraulic cylinder is mounted in a clevis joint (not shown) at the base of the pipe and the piston rod extends upwardly for connection to a block and sprocket, similar to that shown in pipe 27, except the reverse with the chain 68 extending over the pulley 69, and the extending chain 70 is connected at its end to the carriage-retaining lug member 71 to raise and lower the bolster or lift carriage 73 in unison with the carriage 53. One end of the chain 68 is securely fastened to a stationary member (not shown) as in the chain 62.

Figure 9:
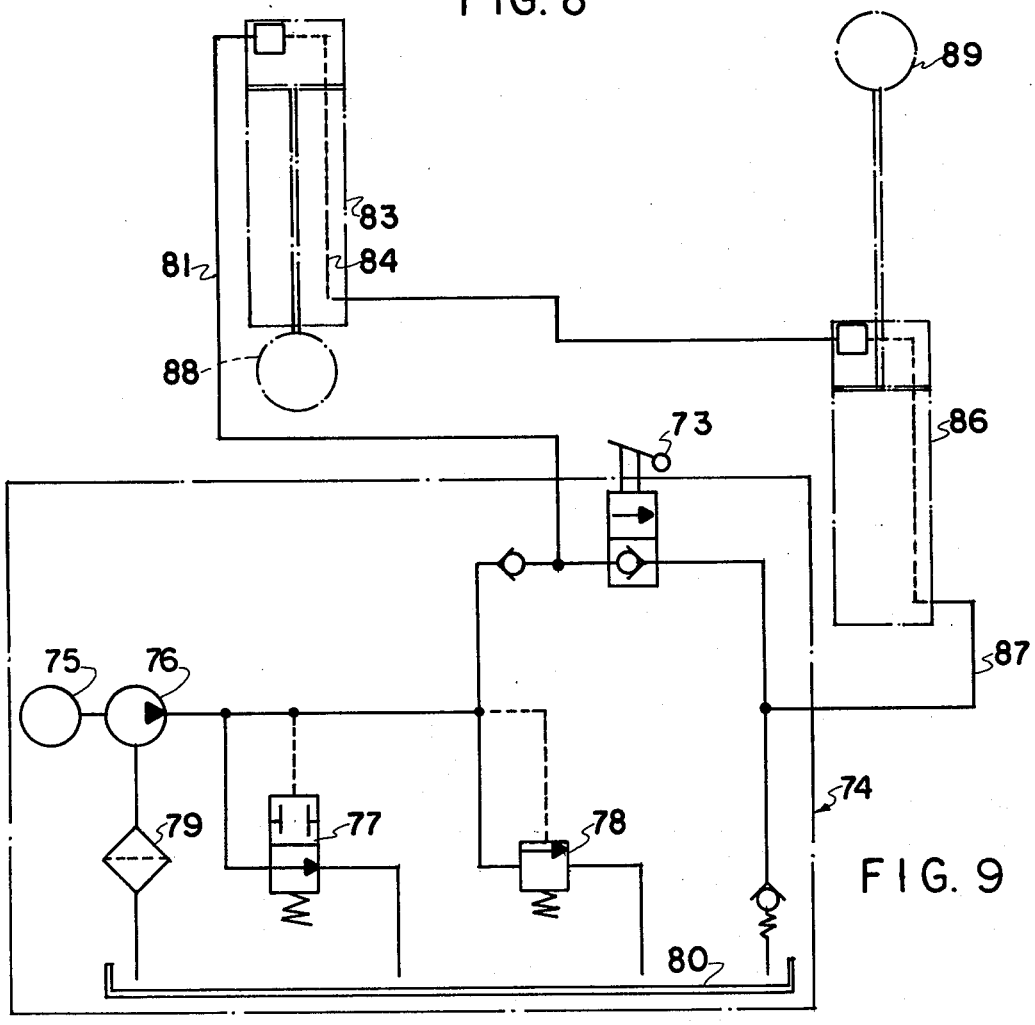
FIG. 9 is a schematic flow diagram of the hydraulic system for the lift.

As shown in FIG. 9, activation of motor 75 will control the power unit that is within the perimeter 74 which contains a release lever 73 to lower the lift, a conventional motor 75, hydraulic pump 76, a load delay valve 77, a pressure relief valve 78, filter 79, and reservoir 80 that will store hydraulic fluid for the system which will be circulated through the line 81 to the non rod end of drive cylinder 83 forcing fluid in the rod end of drive cylinder 83 into the rod end of slave cylinder 86 which forces fluid in the non rod end of slave cylinder 86 back to reservoir 80. To create a continuous fluid circuit, there will be a by-pass in the cylinders 83 and 86 to permit fluid flow to the reservior when the cylinder rod for cylinder 83 is extended and the cylinder rod for cylinder 86 is fully retracted. Also, schmatically illustrated in FIG. 9, the positioning of the pulley 88, over which the chain 62 is supported, will cause the carriage 53 to be at its lowered position, and the pulley 89, over which the chain 68, is supported, on the slave cylinder 86, will cause the carriage assembly 72, through chain section 70, also to be at its lowered position at the same level as carriage assembly or bolster 53. Upon actuation of the hydraulic system, the drive cylinder 83 will lower pully 88 thereby elevating the carriage 53. Correspondingly, the slave cylinder 86 will lower pulley 89 to elevate carriage 72 in an equal amount so that carriages 53 and 72 will be elevated uniformly, and they will always be at the same vertical level relative to each other.

The cylinders 83 and 86 are positively synchronized since they are inverted relative to each other such that the hydraulic fluid in the rod end of the drive cylinder 83 is displaced into the rod end of the slave cylinder 86, and vice versa, making it such that the displacement is simultaneous and in equal amounts. The synchronization of the lifting cylinders eliminatesthe necessity of tying the movement of the two cylinders together with chain or cable mechanisms. When drive cylinder 83 and slave cylinder 86 are completely lowered, a continuous fluid path is opened from pump 76 back to reservoir 80 which replenishes fluid in the synchronizing line 84.

Automatic Lock Mechanism

The automatic looking device illustrated in FIG. 7 prevents the accidental downward displacement of the vehicle supporting carriages 53 and 72. It also prevents the possibility of tipping a vehicle on its side when there is an obstruction under one superstructure or lifting carriage or if a chain or chain support member fails. Referring to FIGS. 1 and 4–8, the automatic locking mefhanism is shown in various details.

A series of vertically aligned and incrementally spaced projecting lugs 90 is mounted securely directly to each pipe 27 and 28, as by welding, with the lugs 90 having a flat upper surface 91 to engage with the automatic lock latching pawl 92 that is pivotally mounted on the automatic lock latch assembly 93 with the latching pawl 92 being provided with a spring 94 to urge or assist engagement of the latching pawl 92 and a lug 90, to be more fully described hereafter.

Figure 5:
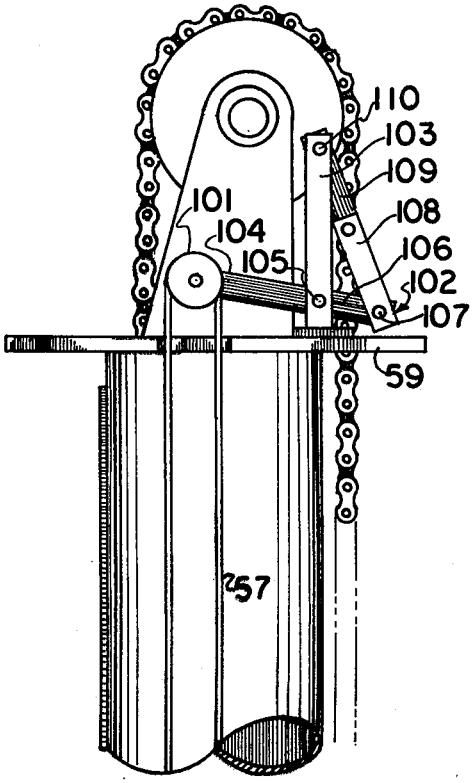
FIG. 5 is a left side view of FIG. 4.
Figure 4:
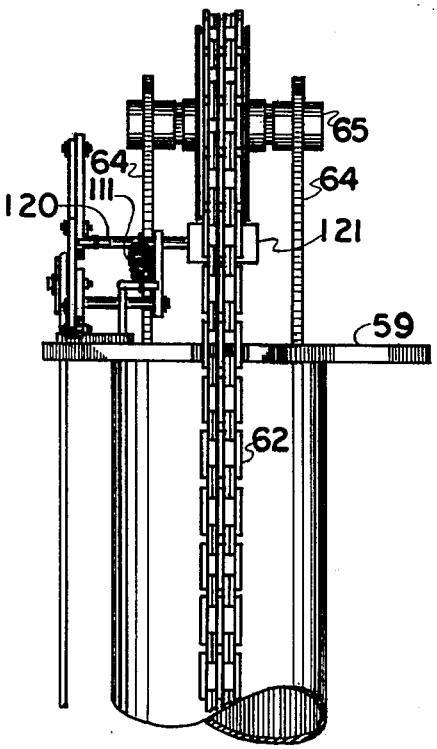
FIG. 4 is a partial view of the top of one stanchion with the pulley and chain elevating mechanism and locking mechanism shown in end view.

In FIG. 8, a portion of the actuating mehanism 95 is illustrated for the automatic locking mechanism in which the foot treadle 96 may be displaced vertically. The plunger 97 passes through plate 98 that supports the pivotable bracket member 99 to which the pulley 100 is rotatably supported on an extension of member 99. The cable 57 is trained over pulley 100 and extends upwardly, as shown in FIGS. 1 and 5 to the rotatable pully 101 that is mounted on the linkage mechanism 102 which forms an upper sensing safety mechanism. A stationary vertical link 103 is secured to the base plate member 59 and the pulley retaining link 104 is pivotally connected at 105 to the lower end of vertical link 103 and has an extending portion 106 which is pivotally connected at 107 to the inclined articulated link 108. Link 108 is connected pivotally to the shortened link 109 that is pivotally connected at the pivot point 110 to the fixed vertical link 103 in the orientation of the upper sensing safety linkage assembly 102 illustrated in FIGS. 1 and 5. The spring 111 will urge the linkage assembly 102 to remain in the condition shown in FIG. 5 thereby maintaining the automatic locking pawl or link 92 in the position shown in FIG. 7 precluding any further downward movement of the lift.

The sensing rod 120 is connected to the assembly 102 at one end and is provided with a flat chain sensing member 121 at the other end which engages and senses the position of the chain 62. Displacement of chain 62 laterally, as shown in FIG. 6, will cause the chain-sensing member 121 to be displaced laterally by the sensing rod 120 and spring 111 to the position shown in FIG. 6.

Figure 6:
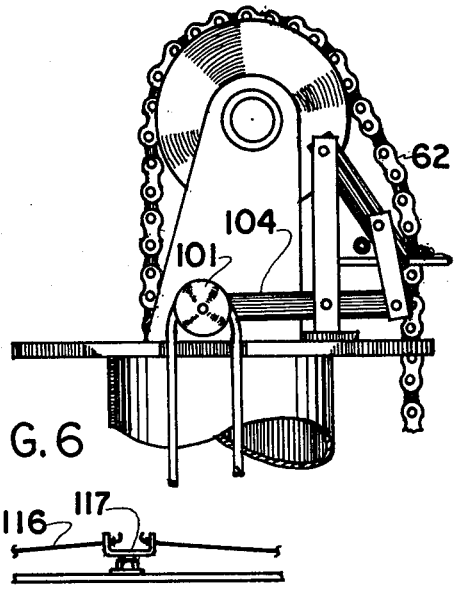
FIG. 6 is a view similar to FIG. 4 in another orientation of the locking mechanism.

The upper sensing linkage assembly 102 will assume the orientation shown in FIG. 6 thereby lowering the pulley 101 and link 104, and permitting the locking pawl 92 to remain engaged with the lug 90 preventing the carriage or bolster members 53 and 72 from being lowered. Upon determining any existing malfunction or blockage problem and rectifying it, the automatic locking mechanism 93 will again be activated so that the locking pawl 92 may be disengaged from engagement with a lug 90 in the normal fashion, and the bolsters 53 and 72 may be lowered. Since the same automatic locking mechanisms 93 are utilized in both pipe stanchions, they will function along with the upper sensing linkage assembly on stanchion 12 as described.

The lower end 85 of the member 99 is provided with a cable anchoring coupling 112 to which an auxiliary cable 113 is attached. The cable 113 follows a sinuous path about the rods 115 that are spaced in staggered relationship to each other before the end 116 of the cable 113 is securely retained in the U-shaped retaining member 117 that is secured in a channel beneath the cover 45. A similar cable arrangement is installed for the other stanchion 12. Displacement of the plunger 97 will cause the rocker arm 118 to pivot about the stationary lug member 119 thereby controlling the displacement and movement of the cable pulley 100.

In the operation of the automatic locking mechanism 93, when the lift is being lowered and either a chain or chain support member fails or an obstruction is encountered by one of the super-structures, the supporting chain will become slack, and be detected as shown in FIG. 6 and described above. The automatic locking latch pawl 92 will be allowed to return to the locked or engaged position because the chain sensing linkage mechanism 102 will assume the position illustrated in FIG. 6, and introduce more slack cable into the system than the foot pedal is able to take up in order to keep the automatic locking pawl disengaged.

I claim:

1. An above-the-floor hydraulic lift comprising: a pair of vertical pipe stanchions having vertically spaced locking lugs thereon spaced laterally from each other to accommodate a vehicle therebetween, a vertically displaceable bolster mounted on each pipe stanchion, each of said bolsters having a pair of pivotally supported cantilever-extending lift arms for cooperatively supporting a vehicle thereon, hydraulic means in sid pipe stanchions for displacing said bolsters in unison through synchronization of said hydraulic means, means for controlling the displacement of said bolsters through said hydraulic means, means for releasably locking said bolsters in position at a predetermined elevation, said means including in a selected vertical position to said vertical pipe stanchions, said automatic locking means including a cable for releasing said automatic locking means from engagement with said locking lugs on said pipe stanchions, and means for overriding the release of said automatic locking means whereby vertical displacement obstruction of a bolster will permit overriding release of said automatic locking means and prevent further bolster displacement.

2. An above-the-floor hydraulic lift as claimed in claim 1, a casing surrounding said pipe stanchions, and a base compartment extending between said pipe stanchions, hydraulic lines extending from the hydraulic means in said pipe stanchions through said base compartment for interconnecting said hydraulic means in each pipe stanchion, and motor and pump means for circulating hydraulic fluid through said hydraulic means.

3. An above-the-floor hydraulic lift as claimed in claim 1, a drive hydraulic cylinder in one vertical pipe stanchion and a driven hydraulic cylinder in the other vertical pipe stanchion, means for connecting said hydraulic cylinders together to operate in synchronization, means including a chain connected to said hydraulic means for controlling the vertical displacement of said bolsters.

4. An above-the-floor hydraulic lift as claimed in claim 1, means on said bolsters restricting bolster rotation in a horizontal plane and for guiding said bolsters vertically on said pipe stanchions, a chain control mechanism cooperatively operable with said hydraulic means connected to said bolsters for displacing said bolsters vertically, means for releasably locking said bolsters in a predetermined position on said pipe stanchions, manual means for releasing said bolsters from locking engagement with said vertical pipe stanchions.

5. An above-the-floor hydraulic lift as claimed in claim 1, means on said bolsters restricting bolster rotation in a horizontal plane and for guiding said bolsters vertically on said pipe stanchions.

6. An above-the-floor hydraulic lift as claimed in claim 5, said bolster restricting means including pipe engaging rollers for guidably supporting said bolsters during vertical displacement.

* * * * *